US007100241B2

(12) United States Patent
Zetti

(10) Patent No.: US 7,100,241 B2
(45) Date of Patent: Sep. 5, 2006

(54) SPRUNG HINGE FOR CLOSING COMPARTMENT ELEMENTS AND THE LIKE

(76) Inventor: Arrigo Zetti, Via Nonantolana, 1227, 41100 Modena (IT)

( * ) Notice: Subject to any disclaimer, the term of this patent is extended or adjusted under 35 U.S.C. 154(b) by 141 days.

(21) Appl. No.: 10/792,696

(22) Filed: Mar. 5, 2004

(65) Prior Publication Data

US 2004/0177476 A1 Sep. 16, 2004

(30) Foreign Application Priority Data

Mar. 14, 2003 (IT) ..... MO2003A0070

(51) Int. Cl.
*E05D 15/32* (2006.01)

(52) U.S. Cl. ..... 16/304; 16/289; 16/283; 16/366

(58) Field of Classification Search ..... 16/304, 16/370, 289, 283, 286, 287, 288, 366, 50, 16/54, 346, 72, 68
See application file for complete search history.

(56) References Cited

U.S. PATENT DOCUMENTS 1,380,312 A * 5/1921 Pearce ..... 16/286
2,520,921 A * 9/1950 Foster ..... 16/401
2,568,225 A * 9/1951 Doman ..... 16/292
3,046,974 A * 7/1962 Walter ..... 126/191
5,341,542 A * 8/1994 Hannan et al. ..... 16/289
5,398,450 A * 3/1995 Cacicedo ..... 49/386
5,664,290 A * 9/1997 Scherrer ..... 16/370
5,980,006 A * 11/1999 Wilhelmstatter et al. 312/319.1
6,243,918 B1 * 6/2001 Zetti ..... 16/298
6,374,459 B1 * 4/2002 Zetti ..... 16/366
6,568,035 B1 * 5/2003 Zetti ..... 16/370
2001/0025398 A1 10/2001 Zetti

FOREIGN PATENT DOCUMENTS

FR 1 480 589 A 8/1967

* cited by examiner

*Primary Examiner*—Brian D. Glessner
*Assistant Examiner*—Mark Williams
(74) *Attorney, Agent, or Firm*—Albert Josif; Daniel O'Byrne

(57) ABSTRACT

A sprung hinge for elements for closing compartments and the like, comprising a first articulated quadrilateral and a second articulated quadrilateral that are respectively associable with an element for closing a compartment or the like and with a structure that is suitable to form the compartment and have a first lever and a second lever in common, and at least one elastic traction element.

10 Claims, 4 Drawing Sheets

SPRUNG HINGE FOR CLOSING COMPARTMENT ELEMENTS AND THE LIKE

The present invention relates to a sprung hinge for doors for closing compartments and the like, i.e., to a hinge that is suitable to produce the snap closure and opening of elements for closing compartments of furniture or cabinets in general such as doors, wings, leaves, shutters and the like, particularly in campers, caravans, coaches, watercraft and in applications in which the closure element is associated with the structure so that it can rotate about a substantially horizontal or optionally inclined axis.

BACKGROUND OF THE INVENTION

Sprung hinges are known which comprise a first articulated quadrilateral and a second articulated quadrilateral, which have a first lever and a second lever in common and in which there are fixed elements constituted respectively by a coupling plate that is designed to be fixed to the fixed structure of the piece of furniture and a plate for fixing to the closure element.

These known hinges generally use springs that act on components of at least one of said articulated quadrilaterals and react to the opening of the closure element by drawing said element toward the closure configuration.

Known types of hinge are not free from drawbacks, including the fact that during opening they require a considerable effort, since it is necessary to overcome the resistance offered by the elastic means, whereas during closure it is necessary to retain the closure element, which is drawn by said elastic means, in order to prevent it from impacting violently against the structure of the piece of furniture, with the risk of damaging it or injuring the user.

The difficulty encountered in opening closure elements fitted by means of known hinges is increased by current aesthetic trends, which use ever smaller grip knobs or handles, which accordingly do not allow to provide a firm traction or retention of said elements.

Further, in view of the fact that the closure elements can be difficult to reach, since they are for example fitted on wall-mounted units that hang at a certain height or other components, it is evidently important to facilitate their use particularly during opening.

Moreover, it must be noted that current safety standards prescribe the use of key-operated or pressure-operated safety devices that ensure the closure of doors on campers, caravans, coaches and the like during transit, preventing their accidental opening and the consequent fall of the items contained in the corresponding compartments, which could injure the passengers.

The application of these auxiliary safety devices is therefore in itself sufficient to keep the doors in the closed configuration independently of the action applied by the applied elastic means.

SUMMARY OF THE INVENTION

The aim of the present invention is to eliminate the above-mentioned drawbacks of known hinges by providing a sprung hinge for elements for closing compartments and the like that allows to facilitate in particular the opening step and allows to prevent said elements from tending to close violently, impacting against the structure of the piece of furniture and causing potentially dangerous situations if, for example, they are used by children or other users, who might inadvertently crush their fingers between the closure elements and the fixed structure of the piece of furniture.

Within this aim, an object of the present invention is to provide a sprung hinge for elements for closing compartments and the like that ensures optimum safety conditions for users.

Another object of the present invention is to provide a sprung hinge that is simple, relatively easy to provide in practice, safe in use, effective in operation, and has a relatively low cost.

This aim and these and other objects that will become better apparent hereinafter are achieved by the present sprung hinge for doors for closing compartments and the like, which comprises a first articulated quadrilateral and a second articulated quadrilateral that are respectively associable with an element for closing a compartment or the like and with a structure that is suitable to form said compartment and have a first lever and a second lever in common, characterized in that it comprises at least one elastic traction means.

BRIEF DESCRIPTION OF THE DRAWINGS

Further characteristics and advantages of the present invention will become better apparent from the following detailed description of a preferred but not exclusive embodiment of a sprung hinge for doors for closing compartments and the like, illustrated by way of non-limiting example in the accompanying drawings, wherein.

DESCRIPTION OF THE PREFERRED EMBODIMENTS

Figure 1:
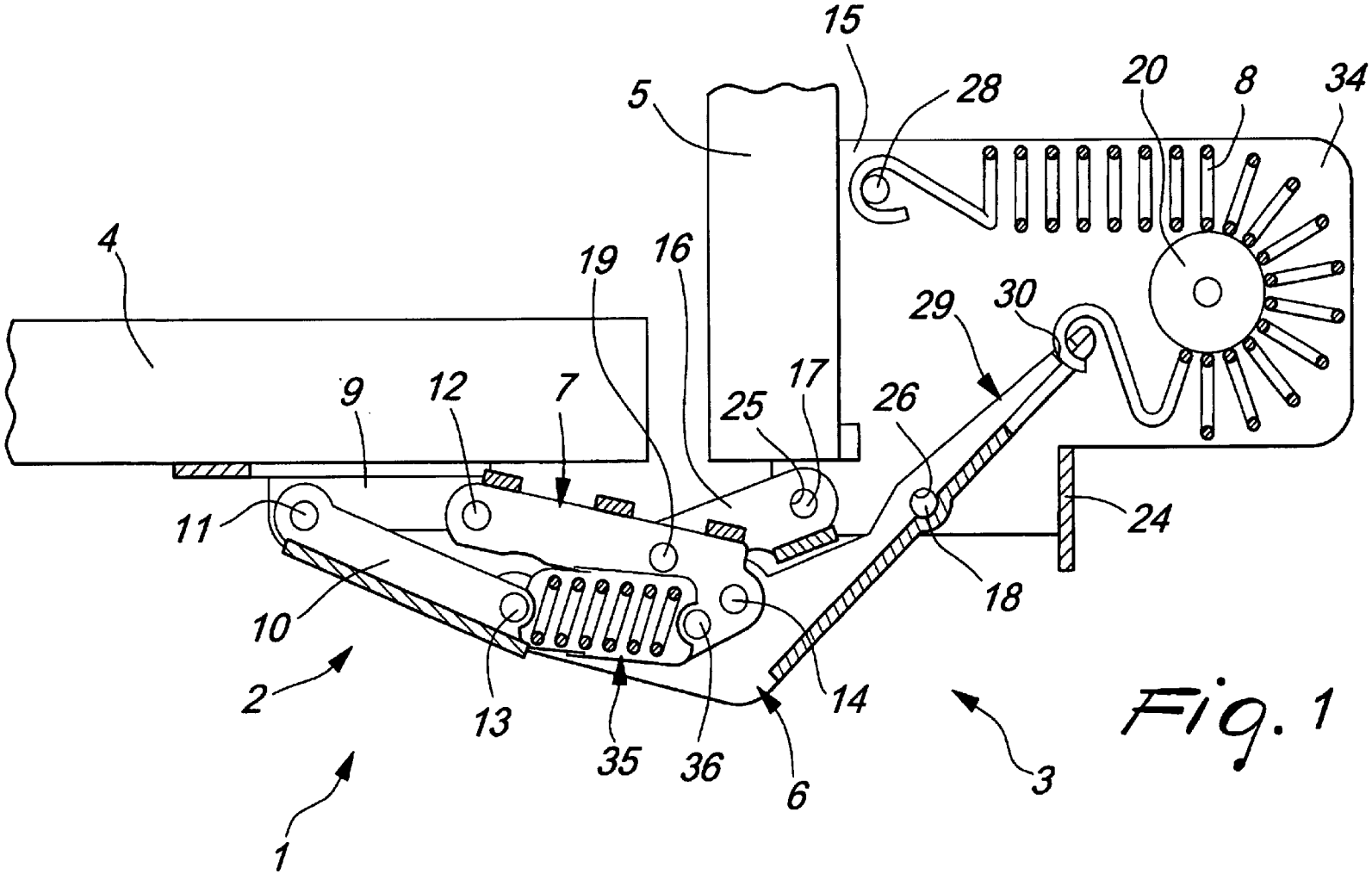
FIG. 1 is a schematic sectional side view, taken along a longitudinal plane, of the hinge according to the invention in the open configuration.

With reference to the figures, the reference numeral 1 generally designates a sprung hinge for elements for closing compartments and the like.

The hinge 1 comprises a first articulated quadrilateral 2 and a second articulated quadrilateral 3, which during use are associated respectively with an element 4 for closing a compartment or the like and with a structure 5 suitable to form said compartment, and have a first lever 6 and a second lever 7 in common.

Figure 2:
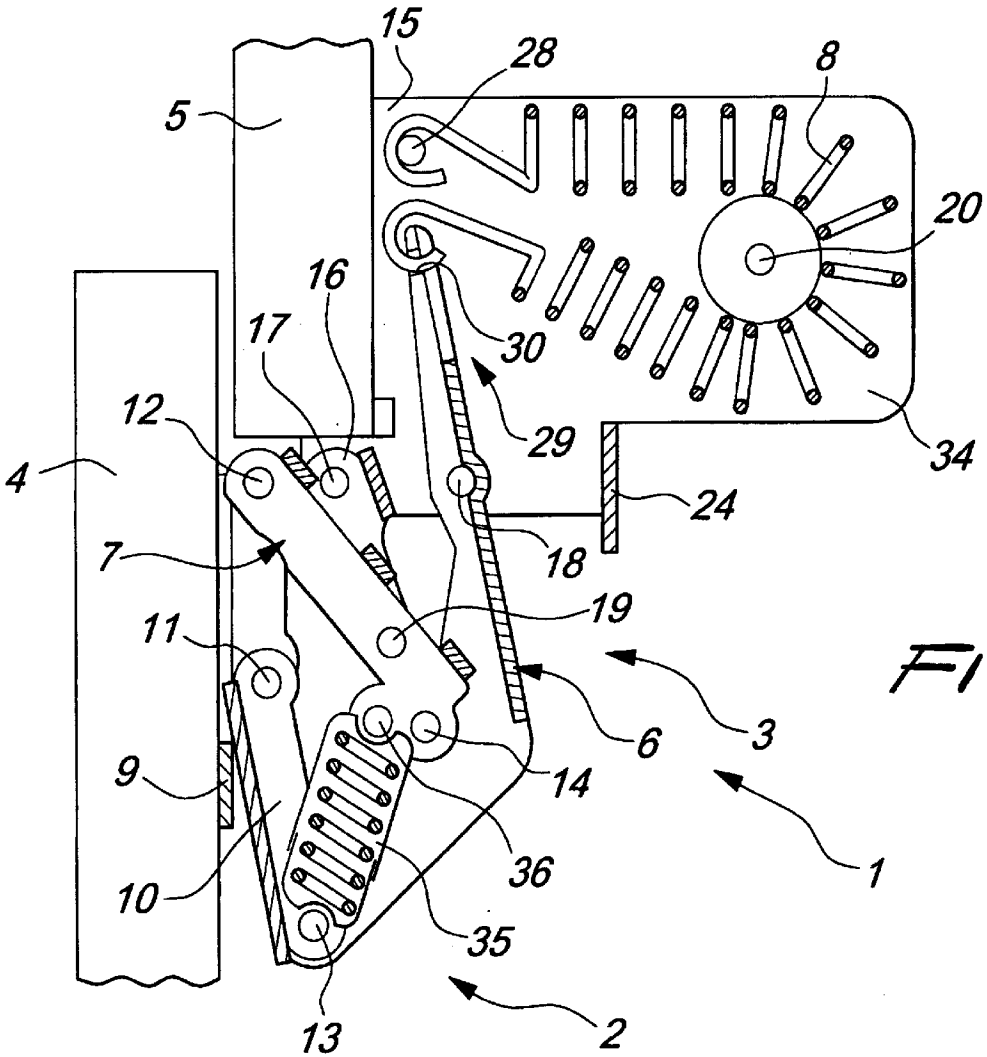
FIG. 2 is a schematic sectional side view, taken along a longitudinal plane, of the hinge of FIG. 1 in the closed configuration.
Figure 3:
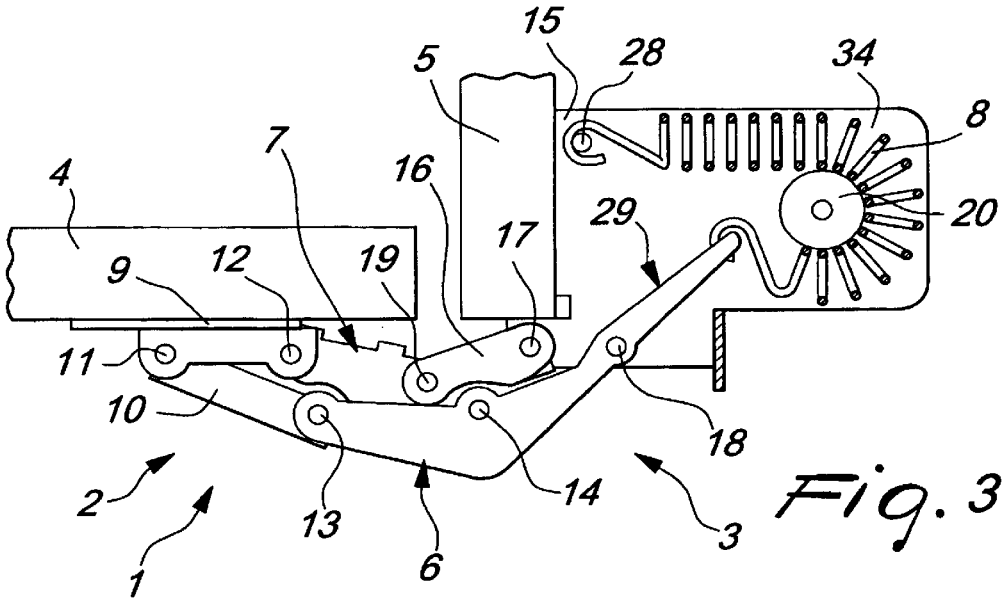
FIG. 3 is a partially sectional schematic side view of the hinge of FIG. 1.
Figure 4:
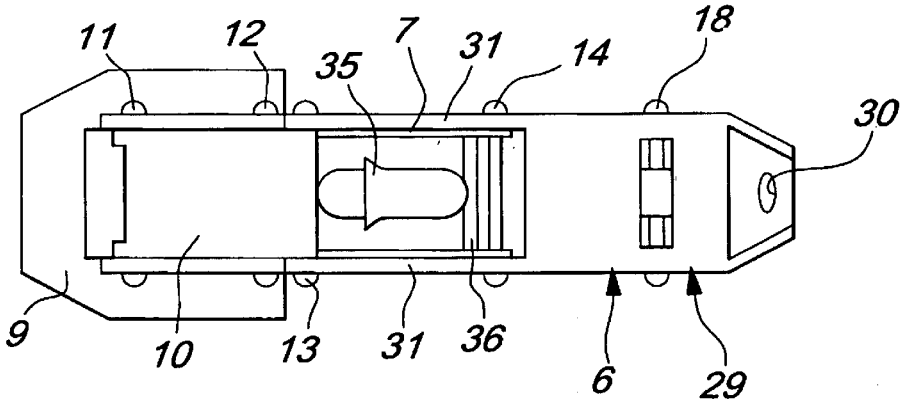
FIG. 4 is a schematic partial front view of the hinge of FIG. 1.
Figure 5:
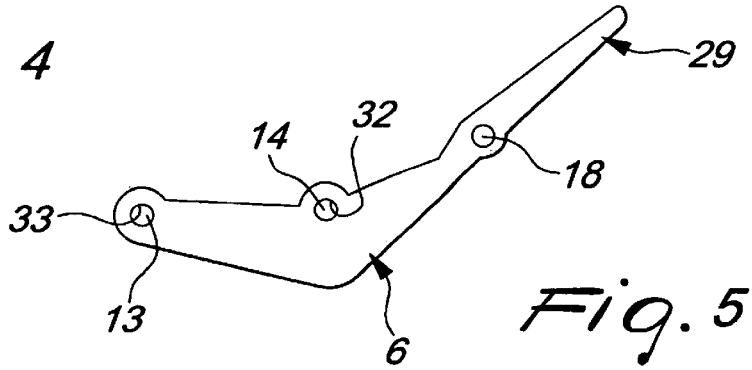
FIG. 5 is a schematic side view of the first lever of the hinge according to the invention.
Figure 6:
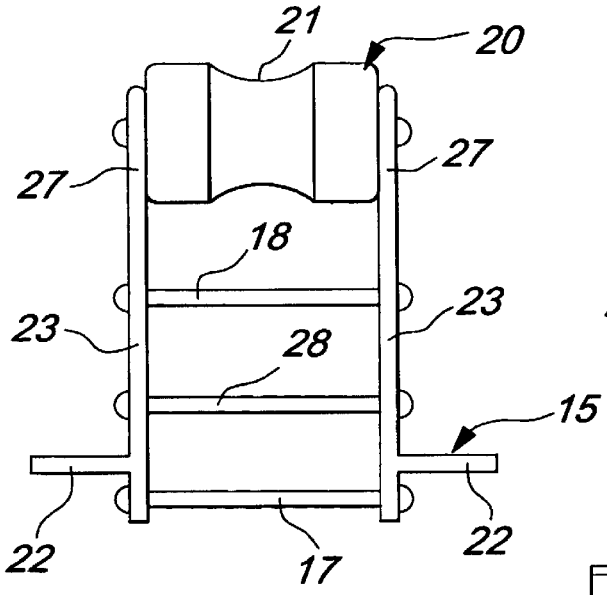
FIGS. 6, 7 and 8 are respectively schematic rear, side and plan views of the coupling plate of the hinge according to the invention.
Figure 7:
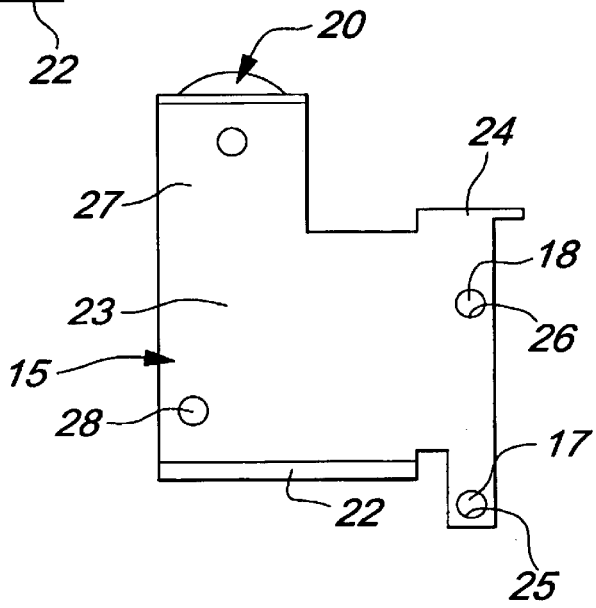
Figure 8:
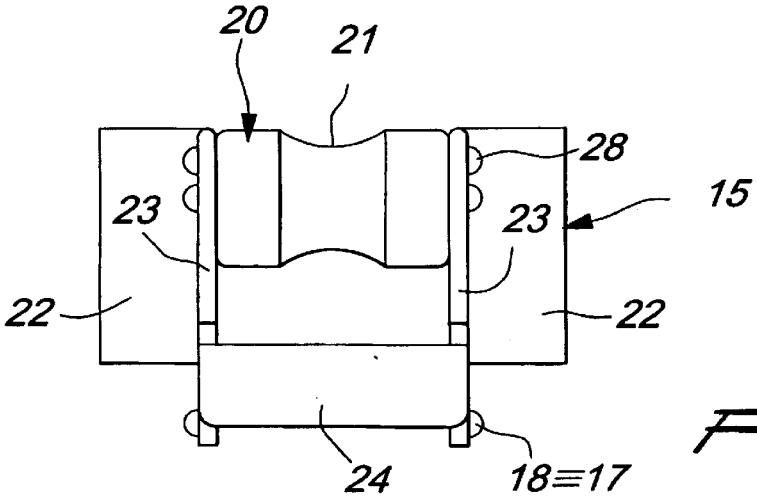

In FIGS. 1 and 2, the hinge 1 is shown in the active condition, i.e., applied to the element 4, which is articulately associated with the structure 5 of a piece of furniture and can oscillate about a substantially horizontal axis between a closed configuration, in which the element 4 is arranged vertically, and an open configuration, in which said element is arranged substantially horizontally.

As an alternative, the hinge 1 might support the element 4 so that it can rotate about an axis that is inclined with respect to the horizontal direction.

The element 4 can be constituted for example by a door, a leaf, a wing, a shutter or the like.

Conveniently, the hinge 1 can be fitted to items for home furnishing and to pieces of furniture or otherwise doors for closing cabinets of vehicles, particularly such as campers, caravans, coaches, boats or the like.

The hinge 1 further comprises an elastic traction means that is associated with the second quadrilateral 3 and is constituted, in the particular embodiment shown in the figures, by a cylindrical helical traction spring 8.

The first quadrilateral 2 is composed of a fixing plate 9, which is suitable to be rigidly associated with the element 4, acts as a frame and is articulately associated with a first rod 10 and with the second lever 7, and the first lever 6, which acts as a linkage and is articulately associated with the first rod 10 and with the second lever 7.

The fixing plate 9 is articulated to the first rod 10 and to the second lever 7 about respective pivots 11 and 12.

The first rod 10 and the first lever 6 are articulately associated about a pivot 13.

The first lever 6 and the second lever 7 are articulately associated about a pivot 14.

The second quadrilateral 3 is composed of a coupling plate 15, which is suitable to be associated with the structure 5, acts as a frame and is articulately associated with a second rod 16 and with the first lever 6, and the second lever 7, which acts as a linkage and is articulately associated with the first lever 6 and with the second rod 16.

The coupling plate 15 is articulately associated with the second rod 16 and with the first lever 6 about respective pivots 17 and 18.

The second rod 16 and the second lever 7 are articulately associated about a pivot 19.

The first lever 6 and the second lever 7 are articulately associated about the pivot 14.

The spring 8 is provided, at its opposite ends, with engagement loops and has a first end that is associated with the first lever 6 and a second end that is associated with, or connected to, the coupling plate 15.

Conveniently, the hinge 1 comprises a roller 20 for supporting the spring 8 on which said spring is partially wound.

The roller 20 is provided with a circumferential groove 21 that can partially accommodate the portion of the spring 8 that is engaged on said roller, so as to avoid twisting or transverse movements with respect to the roller 20 of said spring.

Advantageously, the roller 20 is supported so that it can rotate freely by the coupling plate 15.

The roller 20 is preferably made of a substantially plastic material, such as nylon or Teflon.

The coupling plate 15 comprises two bases 22 that are associated with, or connected to, respective sides 23 joined by a connecting bridge 24.

The sides 23 have, at the connecting bridge 24, two pairs of holes 25 and 26 for the insertion of the pivots 17 and 18 respectively, and have, on the opposite side with respect to the connecting bridge 24, respective tabs 27 for supporting the roller 20, between which said roller is interposed, and means for anchoring the second end of the spring 8 that are constituted by a pivot 28 that is interposed between the sides 23 and on which the corresponding loop of said spring engages.

The first lever 6 comprises a protruding portion 29 that lies between the sides 23 and is provided with means for engaging the first end of the spring 8 that are constituted by an engagement hole 30 in which the corresponding loop of said spring is inserted and engaged.

The first lever 6 further comprises two lateral wings 31 that are mutually parallel and are connected on opposite sides with respect to the protruding portion 29; each wing has a first hole 32 proximate to the centerline of said first lever for the insertion of the pivot 14 and a second hole 33 for the insertion of the pivot 13 that is arranged at the free end of said wing.

Conveniently, the hinge 1 has a shell 34 for protecting the spring 8 that is constituted by a contoured metal plate that is associated with the sides 23 at the pivot 28.

The hinge 1 is further provided with an auxiliary elastic compression means that is constituted by a conventional encapsulated cylindrical helical compression spring 35 that is interposed between an abutment 36 that is rigidly coupled to the second lever 7 and the pivot 13, i.e. the articulation point between the first lever 6 and the first rod 10.

Conveniently, the hinge 1 can be associated with conventional safety devices suitable to ensure the closure of the element 4, of the key-operated or pressure-operated type, which are prescribed by current statutory provisions on moving vehicles in general.

The operation of the invention is as follows:

During the opening of the element 4, the spring 8 tends to return to the non-deformed configuration and therefore facilitates the rotation of said element about the axis of the hinge 1.

Beyond a rotation of approximately 20–30° in the opening direction, the element 4 tends to open spontaneously due to the action applied by the spring 8 to the first lever 6.

During closure, instead, the user has to overcome the resistance of the spring 8; the amount of thrust that the user must apply to the element 4 in order to rotate it about the axis formed by the hinge 1 in the closure direction is greatly reduced by the return action that the spring 35 applies by means of the first rod 10 to said element.

The springs 8 and 35 must therefore be sized and positioned appropriately so that during opening the action of the spring 8 prevails, tending to open the element 4 spontaneously, whereas during closure the action of the spring 35 prevails, drawing said element toward the structure 5.

In practice it has been found that the described invention achieves the intended aim and objects.

In particular, the hinge according to the invention allows to move the closure elements to which it is applied with a rather modest effort on the part of its users and therefore increases practicality and convenience in use.

The invention thus conceived is susceptible of numerous modifications and variations, all of which are within the scope of the appended claims.

All the details may further be replaced with other technically equivalent ones.

In practice, the materials used, as well as the shapes and dimensions, may be any according to requirements without thereby abandoning the scope of the protection of the appended claims.

The disclosures in Italian Patent Application No. MO2003A000070 from which this application claims priority are incorporated herein by reference.

What is claimed is:

1. A sprung binge for a closing compartment element, the compartment being formed by a structure, the hinge comprising: a first articulated quadrilateral and a second articulated quadrilateral that are respectively connectable to the closing compartment element and to the structure of the compartment, said first and second quadrilaterals having a first lever and a second lever thereof in common; said first articulated quadrilateral being constituted by a fixing plate, which is connectable to said closing element and is articulately associated with a first rod and with said second lever, and by said first lever, which is articulately associated with said first rod and with said second lever, said second articulated quadrilateral being constituted by a coupling plate, which is associable with the compartment structure and is articulately associated with a second rod and with said first lever, and by said second lever, which is articulately associated with said second rod and said first lever, further comprising a supporting roller on which at least one elastic traction means is partially wound, the elastic traction means having a first end and a second end, the first end being associated with said first lever, wherein said coupling plate comprises two bases that are associated with respective sides thereof joined by a connecting bridge, said sides being provided, at the connecting bridge, with two pairs of holes for articulated connection to said second rod and to said first lever and, on an opposite side with respect to the connecting bridge, with respective tabs for supporting said roller and with anchoring means for anchoring the second end of said elastic traction means.

2. The hinge of claim 1, wherein said elastic means comprises a cylindrical helical traction means.

3. The hinge of claim 1, wherein said roller is made of a substantially plastic material.

4. The hinge of claim 1, wherein said roller is provided with a circumferential groove in which said traction means is partially accommodatable.

5. The hinge of claim 1, wherein said roller is connected with said coupling plate so as to rotate freely with respect to said coupling plate.

6. The hinge of claim 1, wherein said first lever comprises a protruding portion that lies between said sides and is provided with engagement means for engaging the first end of said traction spring.

7. The hinge of claim 6, wherein said first lever comprises two lateral wings that are connected to said protruding portion, and are each provided with a first hole proximate to a centerline of said first lever for articulated connection to said second lever and with a second hole proximate to a corresponding free end of said lateral wings of the first lever for articulated connection to said second lever.

8. The hinge of claim 1, comprising a shell for protecting said traction means that is associated with said coupling plate.

9. The hinge of claim 1, further comprising at least one auxiliary elastic compression means being arranged interposed between said second lever and the articulation point of said first lever and of said first rod.

10. The hinge of claim 9, wherein said auxiliary elastic means comprises a cylindrical helical compression spring having a first end associated with an abutment that is rigidly coupled to said second lever and a second end associated with a pivot at said articulation point of said first lever and of said first rod.

* * * * *